US005867834A

United States Patent [19]

Simpson

[11] Patent Number: 5,867,834

[45] Date of Patent: Feb. 9, 1999

[54] FRAME-SUPPORTED EAR, FOREHEAD AND NECK GUARD

[76] Inventor: Timothy A. Simpson, 1574 Sugar Maple Way, West Bloomfield, Mich. 48324

[21] Appl. No.: 797,529

[22] Filed: Feb. 7, 1997

[51] Int. Cl.[6] ..... A42C 5/02

[52] U.S. Cl. ..... 2/174; 2/7; 2/171; 2/DIG. 11

[58] Field of Search ..... 2/7, 171, 174, 2/209.3, 209.4, 468, DIG. 11, 181

[56] References Cited

U.S. PATENT DOCUMENTS

| | | | |
|---|---|---|---|
| D. 305,072 | 12/1989 | Ferguson . | |
| 1,255,800 | 2/1918 | Schurmeier . | |
| 1,651,650 | 12/1927 | Walsh . | |
| 1,683,928 | 9/1928 | Smyth . | |
| 1,741,327 | 12/1929 | Merlino | 2/174 |
| 1,772,223 | 8/1930 | Pence . | |
| 1,878,397 | 9/1932 | Hekler et al. . | |
| 2,159,435 | 5/1939 | Gribbin . | |
| 2,640,198 | 6/1953 | Mullen | 2/174 |
| 4,958,385 | 9/1990 | Rushton, Jr. . | |
| 4,971,072 | 11/1990 | Randall . | |
| 5,023,954 | 6/1991 | Lyons . | |
| 5,423,091 | 6/1995 | Lange . | |

*Primary Examiner*—Diana Biefeld
*Attorney, Agent, or Firm*—Ernest E. Helms

[57] ABSTRACT

An elongated, somewhat flexible frame member generally bowed along its length is comprised of a forehead covering member having a pair of first and second orifices receivable of a pair of elastic bands for being removably secured on said frame member, and a first and second ear erection member having a sleeve along a longitudinal edge for being removably attached to the frame member. The ear erection members being of sufficient length to extend behind the neck of a wearer.

19 Claims, 6 Drawing Sheets

FRAME-SUPPORTED EAR, FOREHEAD AND NECK GUARD

BACKGROUND—FIELD OF THE INVENTION

The present invention relates to a frame having removably secured thereon a forehead covering member and a pair of ear erection members that extends to cover the back of a neck, specifically to protect the perimeter along a hairline from being touched by a hot hair-styling devices during hair-styling procedures.

DISCLOSURE STATEMENT

A hot hair-styling device, such as an electrically or gas heated straightening comb or curling iron, used to style one's own hair or that of another can burn the ears, forehead or neck. An ear can be folded and covered with one's fingers to protect them from injury; however, the forehead and neck remain unprotected. Nevertheless, it is awkward to hold an ear with one hand while maneuvering a straightening comb or curling iron with the other hand. A child is accidentally burned due to flinching when reacting to the heat of a hot hair-styling device operated near the hairline.

Inventors have created several types of ear protectors to protect the ears and, in some cases the forehead and neck of a wearer from heat applied to the hair during certain hair styling procedures. All inventions heretofore known either encloses or covers the ears. These inventions fail to position the ears away form the head and prohibits hair-styling devices from accessing hair behind them. For example, the U.S. Pat. No. 2,159,435 to T. P. Gribbin discloses an ear and forehead protector that covers the ears but does not position them away from the head. The U.S. Pat. No. 1,772,223 to L. M. Pence shows an ear protector designed to enclose the ears with cupped-shape enclosures attached to the ends of an adjustable band. The invention of Pence extends under a wearer's chin and uses loops to hook behind the ears. The invention does not provide a means to pull the ears away from the head nor does it provide protection to the forehead or neck.

An inventor, C. C. Randall, created an ear brace that uses an elastic band to hold the ears downward in a position folded forward and away from the head. The invention, U.S. Pat. No. 4,971,072 discloses an ear brace that uses spring clips attached to the ends of an elastic band that extends under a wearer's chin. C. C. Randall does not claim an ear brace prevents burns to a wearer's forehead, ears or neck. Neither does Randall claim an ear brace can be worn during hair-styling procedures where heat is applied to the hair. However, Randall's ear brace would suffer from numerous disadvantages if used to protect a wearer's ears from burns. For example, the ear brace clips onto the top edge of an ear leaving it's side portion unprotected. The elastic-band tension must be sufficient to keep the ears from unfolding, which could occur as the elastic band relaxes when the head moves during a hair-styling procedure. To remain attached to the ears, the ear clip's spring pressure must counteract the elastic band tension; however, excessive clipping pressure will cause discomfort to some wearers. Eliminating discomfort by reducing the clipping pressure with a soft material or spring reduces the necessary force required to keep the clips secured to a wearer's ears. Thus, chances of the spring clips being pulled of during use is increased when a soft is material or spring is used.

All other ear guards and ear protectors that encloses or covers the ears heretofore known suffer from a number of disadvantages also. That is, the manner in which the ears are enclosed or covered prohibits access to hair behind them. In general, an apparatus used to cover or enclose an ear is larger than the ear itself and covers some of the hair. Also, to accommodate different size ears, many sizes and shapes of enclosures and covers are required, which would be expensive to manufacture.

Some inventors have attempted to eliminate the occurrence of burn injuries to the forehead and neck areas as well as the ears. For example, U.S. Pat. No. 5,423,091 to S. M. Lange and U.S. Pat. No. 4,958,385 to R. C. Rushton discloses a headband used to cover the ears, forehead and neck regions of a hairline. These inventions, however, fail to position the ears for access to hair behind them. Furthermore, the entire hairline of a person must be accessible to a hair-styling device during certain hair preparations; such as, hair straightening. Generally, a hairline contour is irregular and would be difficult to follow with a headband without covering portions of the hair. This is most likely to occur if the edges of the headband are simply straight and parallel to each other. If a headband is designed to match the contour of an individual's hairline, it would not likely match that of another. Therefore, an edge of a headband must be capable of being shaped repeatedly to match different hairlines. However, it would be difficult for such a headband to maintain its shape while gripping the forehead and neck, which are at different angles and elevations with respect to each other.

Other ear guards and protectors heretofore known uses a frame member that extends under the chin and is supported around the outer edge of a wearer's ears. They include; U.S. Pat. No. 1,878,397 to C. P. Hekler, U.S. Pat. No. 1,683,928 to C. M. Smyth and U.S. Pat. No. 1,651,650 to B. M. Walsh. In these inventions the ear guards are attached to the ends of a resilient frame member. The frame member ends are spaced apart a distance less than the width of a wearer's head between the ears. When the frame member is urged apart and released on a wear's head support pressure is applied around the perimeter of the ears to hold the frame member in place. This support pressure cannot be adjusted and may cause discomfort to some wearers. Furthermore, the ears are completely covered prohibiting access to hair behind them, and the forehead and neck are not protected.

SUMMARY OF INVENTION

In the present invention, a frame member having a plurality of bends and generally bowed along its length has removably attached a pliable forehead covering member, a pair of ear erection members which are of sufficient length to be adjustably fastened behind the neck. The frame member is generally bowed to follow the contour of the forehead and is preferably thin so as not to interfere with a wearer's hairline along the sides of the head. The frame member in the present invention is comprised of a steel material having a round cross-section. However, the cross-section of the frame member can comprise other shapes; such as, oval, square, triangular, etc. To achieve the preferred shape in the present invention, the frame member may be comprised of any other formidable or moldable material; such as, polyethylene, polypropylene, vinyl, nylon, rubber, various impregnated or laminated fibrous materials, various plastic materials, etc. The frame member is preferably light weight and somewhat flexible so that the ends may be slightly urged apart for positioning on a wearer's head. This flexible feature, however, is not a requirement to support the present invention on a wearer's head.

Although somewhat flexible, the frame member must be rigid enough to support forces exerted thereon by elastic bands. A pair of elastic bands formed in a loop encloses a portion of a forehead covering member and a straight vertical portion of the frame member. The forehead covering member spans the frame member between the two vertical straight sections. The forehead covering member has an upper edge extending the full length and lying adjacent to a wearer's hairline across the forehead, and opposite side edges that lie adjacent to the hairline along the sides of the forehead. In the present invention the forehead covering member is comprised of a plastic material formidable to the general bow of the forehead. The plastic used, however, must not melt when momentarily touched by a hot hair-styling device when the invention is worn. The temperature limit of a plastic should preferably be higher than a maximum operating temperature of a hair-styling device that could cause heat damage to a wearer's hair. The top surface of a plastic forehead covering material may be laminated with a heat resistance material to improve thermal insulation. To improve comfort, the surface urged against a wearer's forehead is preferably laminated with a thin foam rubber material.

The frame member, which extends across the forehead and along its sides, has attached to each end a pair of pliable ear pieces that hooks behind a wearer's ears. The ear piece is preferably of sufficient length so that it can be shaped around the hairline along the sides of a wearer's forehead and temples. An ear erection member having a sleeve along a longitudinal edge thereof receives an ear piece. The ear erection members are of sufficient length to extend below the hairline and then adjustably fastened behind a wearer's neck. An ear erection member is preferably comprised of a heat resistance material of sufficient weight to enfold an ear.

Some objects and advantages of the present invention are to provide a frame-supported ear, forehead and neck guard that; 1) is easy to put on and remove, 2) has removable protective coverings that are easily removed when worn out, soiled or require replacement for sanitary purposes when shared among different wearers, 3) is light weight and of durable construction, 4) consist of a material that cleans with a mild detergent, 5) is simple and inexpensive to manufacture. Still other objects and advantages will become apparent from a consideration of the ensuing description and drawings.

BRIEF DESCRIPTION OF THE DRAWINGS

A preferred embodiment of the frame-supported ear, forehead and neck guard of the present invention is illustrated in the accompanying figures.

DETAILED DESCRIPTION OF DRAWINGS

Figure 1:
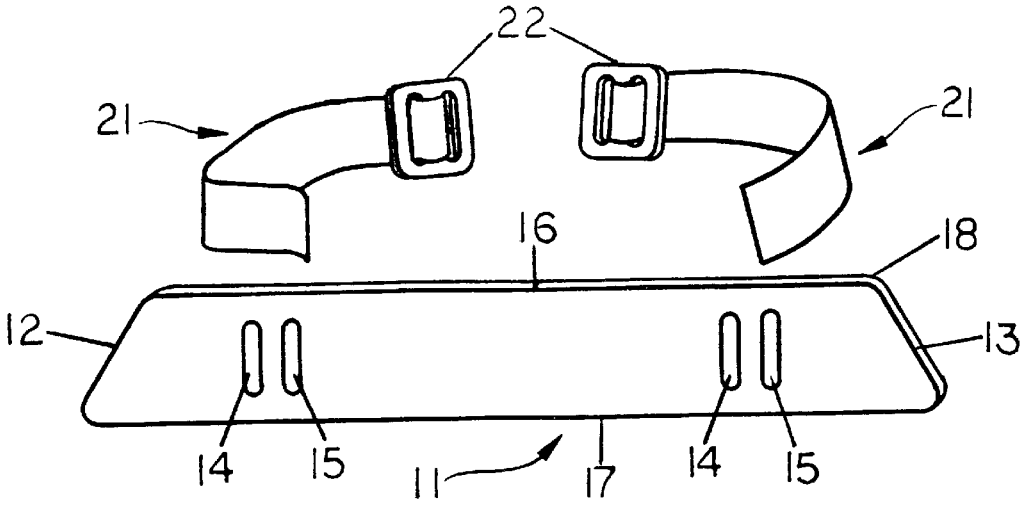
FIG. 1 is a front view of a forehead covering member of a preferred embodiment of the present invention.
Figure 1A:
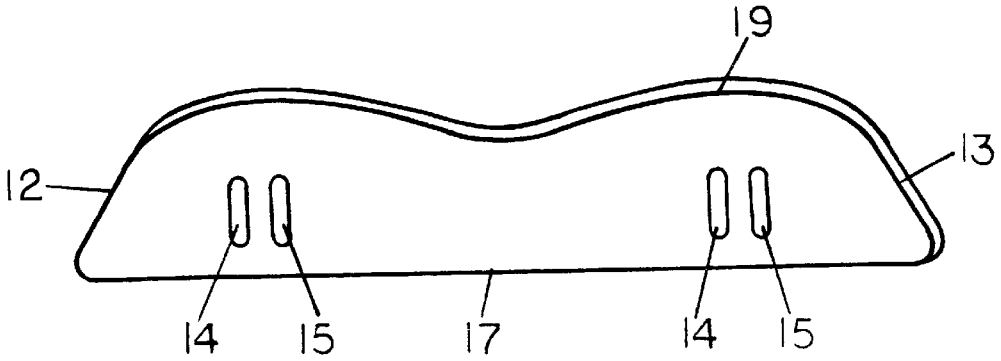
FIG. 1A illustrates an alternate preferred embodiment of a forehead covering member which has the same features as the preferred embodiment shown in FIG. 1 except for a unique top edge contour.

As illustrated in a preferred embodiment of the present invention (FIG. 1), a forehead guard or forehead covering member 11 extends between a pair of opposite side edges 12 and 13. The side edges 12 and 13 are separated a distance suitable so that the forehead covering member 11 extends to a wearer's hairline along the sides of the forehead when the device is worn. An upper edge 16 lies adjacent to a wearer's hairline extending across the forehead. In the embodiment shown in FIG. 1 a forehead covering member 11 which is self supporting in the free state comprises a thin plate with a foam lining 18 towards the wearer's head. An important feature of the forehead covering member 11 is that edges 16, 12 and 13 are cut to closely match the contour of a wearer's hairline. This feature is illustrated in FIG. 1A which shows a forehead covering member with an edge 19 shaped to match a hairline that recedes from the center towards the sides of a wearer's forehead. All features shown in FIG. 1A are identical to features shown in the preferred embodiment (FIG. 1) and are therefore assigned the same reference numbers except for edge 19. In a preferred embodiment of the present invention the forehead covering member 11 is comprised of a polymeric material. The forehead covering member 11 is preferably generally bowed as shown in FIG. 3 and is approximately 125 mm in length, 25 mm in width, and 2 mm thick.

The forehead covering member 11 has a pair of first and second orifices 14 and 15, respectively. The orifices are spaced form a side edge 12 and 13, and are preferably perpendicular to a bottom edge 17 and parallel to each other. A first orifice 14 is preferably located about each side edge 12 and 13, with a second orifice 15 spaced between the first orifice 14 and the center of the forehead covering member 11. In a preferred embodiment the second orifice 15 is spaced relatively close to the first orifice 14. The location of the first orifice 14 will depend on the location of a pair of first bends 32 of a frame member 31, as will be explained more fully hereinafter.

Figure 3:
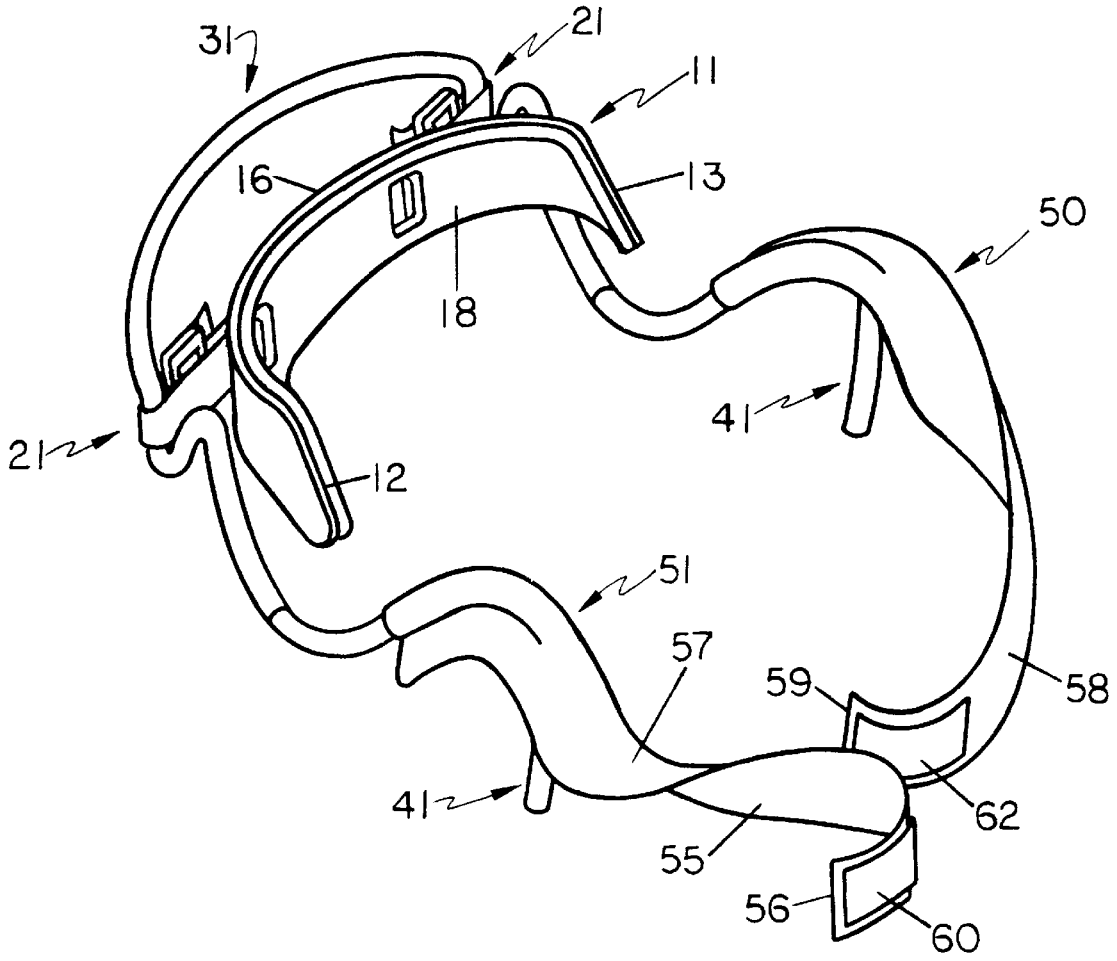
FIG. 3 illustrates the forehead covering member and ear erection members attached to the frame member of a preferred embodiment of the present invention, a neck covering portion of the ear erection member is also shown.

The forehead covering member 11 uses a pair of tensioning elastic bands 21 to secure it to the frame member 31, as illustrated in FIG. 3. The forehead covering member 11 receives each elastic band 21 through orifices 14 and 15 (FIG. 1). Each elastic band 21 having attached to one end a fastening mechanism 22, is securely fastened capturing a portion of the forehead covering member 11 between orifices 14 and 15. The shape of orifices 14 and 15 will depend on the width and thickness of the elastic band 21. The elastic band in the preferred embodiment is approximately 12 mm wide and 2 mm thick hence, the shape of the orifices are somewhat elongated.

Figure 2:
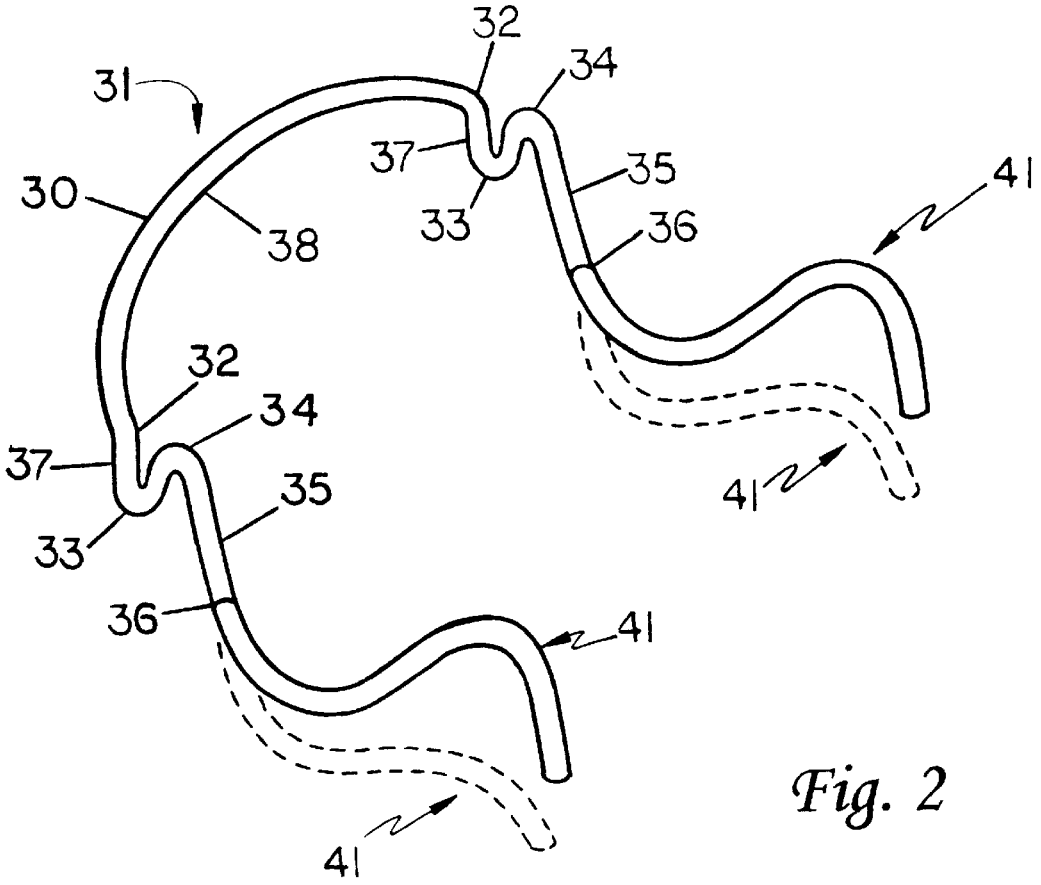
FIG. 2 is an isometric view of a frame member of a preferred embodiment of the present invention.

A frame member 31 illustrated in FIG. 2 in a preferred embodiment of the present invention, comprises a round steel wire (approximately 3 mm in diameter) bowed along its length to form a U-shaped member. The frame member 31 generally follows a wearer's hairline extending from the temples and along the forehead. The frame member 31 is preferably of a length sufficient so that it's two opposite ends 36 extends in front of and above the ears when the device is placed on a wearer's head. The frame member 31 preferably comprises at least one first pair of opposite bends 32 on opposite sides of a forehead crossing section 30. The forehead crossing section 30 is also preferably bowed at least slightly, so that it will conform generally to the shape of a wearer's forehead. This bowed condition may be a single general bow along the length of the forehead crossing section 30 between the two opposite first bends 32, or may comprise a center bend 38, or a plurality of bends (not shown), or combination of a general bow and one or more bends (not shown). The first pair of bends 32 are located such that a pair of side extensions 35 of the frame member 31 extends in front of a wearer's hairline along the sides of the forehead.

The frame member side extension 35, between bend 32 and end 36 thereof, comprises a second bend 33 and a third bend 34 as illustrated in FIG. 2. In a preferred embodiment of the present invention shown, the second and third bends are preferably of an obtuse angle. The smaller angle of the second bend 33 faces opposite the first bend 32, and the smaller angle of the third bend 34 faces opposite the second bend 33. The purpose of the second bend 33 is to construct a pair of straight sections 37 which are captured within each elastic band 21 as shown in FIG. 3. The purpose of the third bend 34 is to orientate each side extension 35 downward so that frame member ends 36 are slightly above a wearer's ears.

Figure 5:
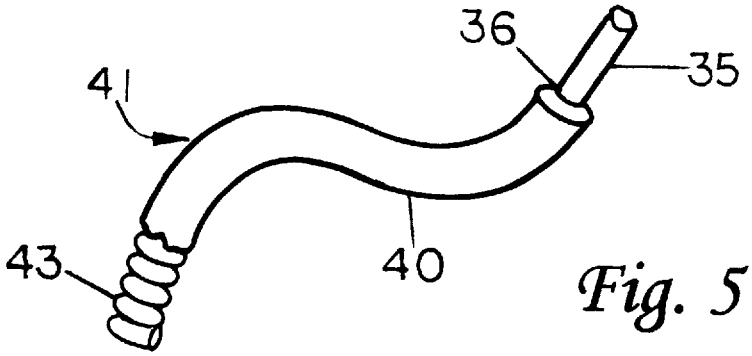
FIG. 5 illustrates an ear piece of a preferred embodiment of the present invention.
Figure 5A:
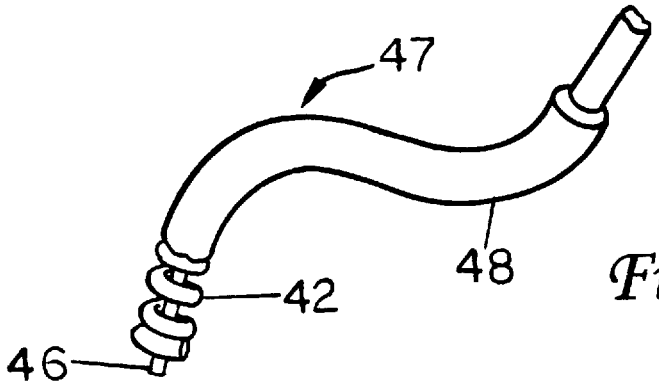
FIG. 5A illustrates an alternate preferred embodiment of an ear piece.
Figure 5B:
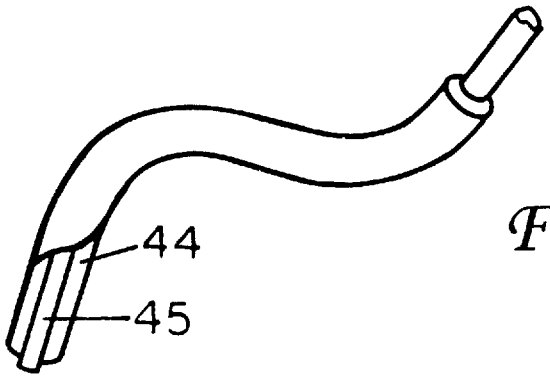
FIG. 5B illustrates another alternate preferred embodiment of an ear piece.

Each frame member end 36 have securely attached thereon an ear piece 41. The ear piece 41 is preferably pliable so that it can be freely bent to conform to the curved contour of a wearer's ear and hairline (FIG. 2). The ear piece 41 is of sufficient length to extend around a rearward portion of wearer's ear lap and hairline along the temple region. In a preferred embodiment of the present invention shown in FIG. 5, an assembled ear piece 41 comprises a coiled wire 43 and a polymeric covering layer 40. The coiled wire 43 preferably has an outside diameter of approximately 7 mm and a length of approximately 150 mm. An ear piece with an outside diameter too large will be pulled over a folded ear whereas a diameter that is too small may cause discomfort to a wearer. Therefore, the outside diameter of an ear piece is an important feature dimension. The wire used to construct the ear piece in the preferred embodiment is preferably pliable so that when coiled it does not become spring like but maintains it's shape when bent. However, in an alternate preferred embodiment as illustrated in FIG. 5A an ear piece 47 is comprised of a spring 42, a pliable wire 46 and a covering layer 48. The wire 46 which extends through the inside diameter of the spring 42 is securely fastened to both ends of the spring. The wire 46 being pliable and somewhat stiff is responsible for maintaining the shape of the ear piece 47 when bent. In another alternate preferred embodiment shown in FIG. 5B, a soft pliable material 44 such as rubber, plastic or another suitable polymeric material is used to encase a soft pliable wire 45.

Figure 6:
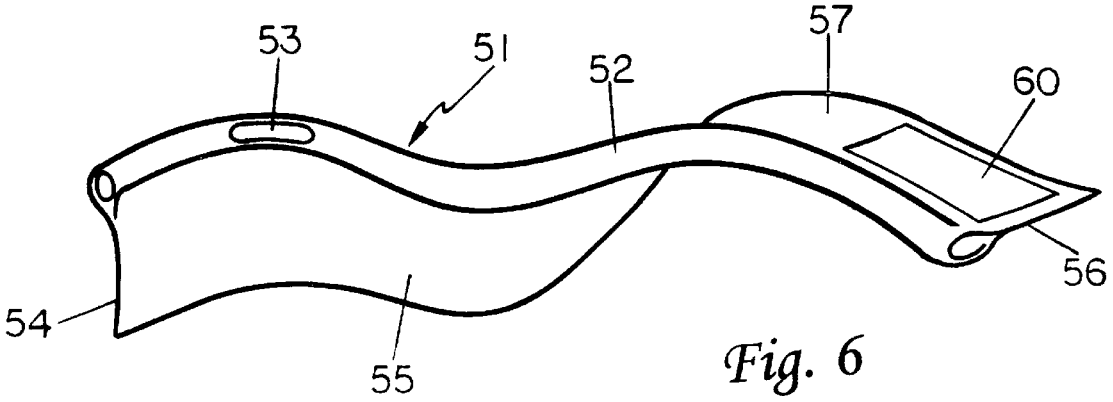
FIG. 6 illustrates an ear erection member of a preferred embodiment of the present invention.

A first and a second ear erection member 51 and 50, respectively, has a longitudinal sleeve (see FIG. 6) 52 that contains an elongated hole 53 about a first side edge 54 on a bottom side 55 towards a wearer's ear. The end of an ear piece 41 is passed through the sleeve 52 and elongated hole 53 thereof from side edge 54. The elongated hole 53 permits each ear erection member 51 to be lifted so that they can be aligned with the hairline around the neck without unhooking the ear pieces 41 from behind the ears. Attached on a top side 57 of the first ear erection member 51 about a second side edge 56 thereof is a fastener 60 (see FIG. 6). The bottom side 58 of the second ear erection member 50 has a fastener 62 attached about a second side edge 59 (FIG. 3). The fasteners permits the ear erection members 51 and 50 to be adjustably fastened behind the neck of a wearer. Fastening the ear erection members behind the neck is only required when protection to the neck is desired. It is not required to fasten the ear erection members behind the neck to support the invention on a wearer's head. In the preferred embodiment of this invention VELCRO® hook and loop type fasteners were used. However, in an alternative preferred embodiment fasteners such as snaps or thin wire hooks and loops (not shown) can be used. An ear erection member is preferably comprised of a heat resistance material.

DESCRIPTION OF MAIN EMBODIMENT

To assemble a preferred embodiment of the present invention, a portion of the forehead covering member 11 between orifices 14 and 15 and the frame member straight portion 37 are captured within an elastic band 21. The elastic bands 21 and a portion of the forehead covering member 11 connected there between compliantly spans across the frame member 31. Each elastic band 21 is adjusted to apply tension to the forehead covering member 11. Finally, each ear piece 41 is shaped about frame member end 36 so as not to interfere with a wearer's hairline along the temples.

Figure 4:
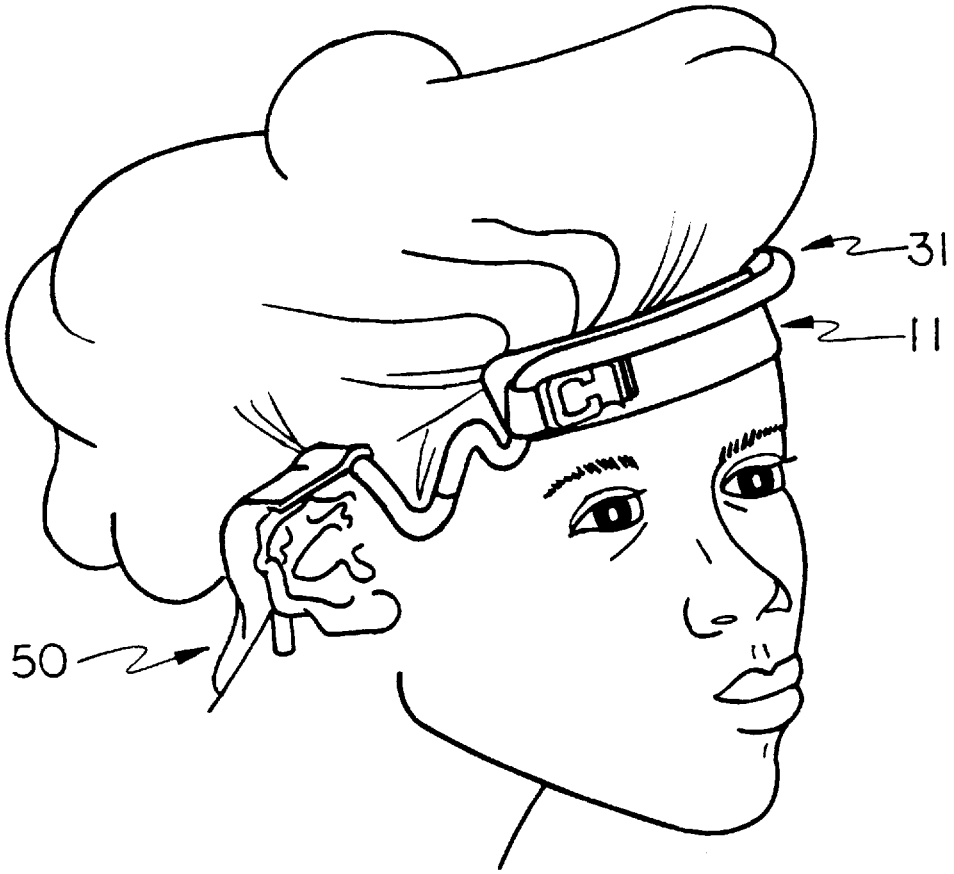
FIG. 4 illustrates a preferred embodiment of the present invention in position as worn on the head.

The manner of using a preferred embodiment of the present invention is to place the forehead covering member 11 on the forehead and urge the frame member rearward towards the ears. The forehead crossing section 30 is held steady as each ear piece 41, with ear erection member assembled thereon, is shaped around the base of a wearer's ear. As the forehead crossing section 30 is released the frame member 31 relaxes forward and the ear erection members pull the ears away from the wearer's head. The reaction forces applied behind the wearer's ears and upon the forehead holds frame member 31 securely about the head as shown in (FIG. 4). The frame member 31 being supported behind the wearer's ears is pushed upwards until the top edge 16 of the forehead covering member 11 is aligned adjacent to the hairline. The forehead covering member 11 has side edges 12 and 13 that are aligned adjacent to the wearer's hairline along each side of the forehead. A second side edge 56 of a first ear erection member 51 has attached to a top side 57 a fastener 60 and a second ear erection member 50 has a fastener 62 attached to a bottom side 58 about a side edge 59 (FIG. 3). Finally, the ear erection members 51 and 50 are extended behind the wearer's neck below the hairline and are adjustably fastened together. It is important to note that the frame member can be removed form the wearer's head without altering the shape of the ear pieces. Also, reshaping the ear pieces is not required to place the frame member on the wearer's head unless the shape has been altered. This feature facilitates easy use of the frame-supported ear, forehead and neck guard.

Although the description above contains many specificities, these should not be construed as limiting the scope of the invention but as merely providing illustrations of some of the presently preferred embodiments of this invention. For example, an ear piece can comprise a soft pliable wire and not include a spring; the frame member cross-sections and thickness can comprise other shapes, such as ovals, circular, triangular, etc.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

I claim:

1. An apparatus for protecting the head of a wearer along the perimeter of the hairline comprising:

a generally U-shaped frame member having a forehead crossing section joined with extreme opposite ends, each respective end designed to extend towards an ear of a wearer's head when said U-shaped frame member is positioned on a wearer's head;

a forehead covering member suspended from said frame member, said forehead covering member having a major portion of its length hanging freely and spaced away from said frame member, said forehead covering member being generally conformable to a wearer's forehead; and a pair of ear pieces, each ear piece being an elongated member such that each said ear piece has a first end connected with a respective end of said frame member, each ear piece has a second end with a hook, the hook being designed for placement around a rearward portion of a respective ear lap of a wearer's head, said ear piece being designed to urge said forehead covering member against a wearer's forehead.

2. An apparatus as described in claim 1 wherein said forehead covering member includes a first member suspended from said frame member by an elastic tensioning member.

3. An apparatus as described in claim 2 wherein two elastic tensioning members suspend said forehead covering member first member from said frame member.

4. An apparatus as described in claim 2 wherein said forehead covering member first member is made from a material that retains its shape in a free state.

5. An apparatus as described in claim 2 wherein said elastic tensioning member is captured between a pair of bends provided in said frame member.

6. An apparatus as described in claim 1 wherein said forehead covering member has a top edge and a pair of opposite side edges that are designed to closely match a wearer's hairline across the top and along the sides of a wearer's forehead, respectively.

7. An apparatus as described in claim 1 wherein each of said ear pieces has an ear erector attached thereto to at least partially cover and to protect a wearer's ears from the heat of a hair-styling device.

8. An apparatus as described in claim 7 wherein each ear erector is designed to additionally be of a length to extend below a hairline of a wearer's neck to cover a wearer's neck and to protect a wearer's neck from the heat of a hair-styling device.

9. An apparatus as described in claim 8 wherein each ear erector is designed to be adjustably fastened to said other said ear erector below the hairline of a wearer's neck.

10. An apparatus as described in claim 7 wherein each said ear erector is designed to surround and extend beyond the edge of a wearer's ear.

11. An apparatus as described in claim 7 wherein said ear erector is designed to enfold the ear and support a wearer's ear away from a wearer's head.

12. An apparatus as described in claim 7 wherein each said ear erector is removable from said ear piece to which it is attached.

13. An apparatus as described in claim 1 wherein each said ear piece is pliable.

14. An apparatus as described in claim 1 wherein each said ear piece includes a coiled wire.

15. An apparatus as described in claim 1 wherein each said ear piece includes a solid pliable wire.

16. An apparatus as described in claim 1 wherein each said ear piece includes a polymeric material cover.

17. An apparatus for protecting the head of a wearer along the perimeter of the hairline comprising:

a generally U-shaped frame member having a forehead crossing section joined with extreme opposite ends, each respective end designed to extend towards an ear of a wearer's head when said U-shaped frame member is positioned on a wearer's head;

a forehead covering member generally compliantly suspended by elastic tensioning members from said frame member, said forehead covering member being generally conformable to a wearer's forehead; and first and second ear pieces, each ear piece having a first end connected with a respective end of said frame member, each ear piece having a second end with a hook, the hook being designed for placement around a respective ear of a wearer to urge said forehead covering member against a wearer's forehead, each said ear piece being pliable and having an ear erector attached thereon.

18. An apparatus for protecting the head of a wearer along the perimeter of the hairline comprising:

a generally U-shaped frame member having a forehead crossing section joined with extreme opposite ends, each respective end designed to extend toward an ear of a wearer's head when the U-shaped frame member is positioned on the wearer's head;

a forehead covering member being generally conformable to a wearer's forehead, said forehead covering member generally compliantly suspended from said frame member;

first and second ear pieces, each ear piece having a first end connected with a respective end of the frame member, each ear piece designed to have a second end to be hooked around a respective ear to urge the forehead covering member against a wearer's forehead, each said ear piece being pliable; and ear erectors, each ear erector being adapted to extend below the hairline of a wearer's necks and each ear erector having a first end attached with a respective ear piece, and each ear erector having a second end to which a fastener is attached for extending behind a wearer's neck and being designed to adjustably fasten to said other ear erector to cover and to protect the neck region of a wearer's head.

19. An apparatus for protecting the head of a wearer along the perimeter of the hairline comprising:

a generally U-shaped frame member having a forehead crossing section joined with extreme opposite ends, each respective end designed to extend towards an ear of a wearer's head when the U-shaped frame member is positioned on the wearer's head;

a forehead covering member generally compliantly spanning said frame member, said forehead covering member being generally conformable to a wearer's forehead, said forehead covering member including a first member suspended from said frame member by an elastic tensioning member; and a pair of ear pieces, each ear piece having a first end connected with a respective end of said frame member, each ear piece having a second end adapted to hook around a respective ear of a wearer's head, the ear piece being designed to urge said forehead covering member against a wearer's forehead.

* * * * *